US006742355B2

(12) United States Patent
Ichimura et al.

(10) Patent No.: US 6,742,355 B2
(45) Date of Patent: Jun. 1, 2004

(54) RECEIVER-DRIER FOR USE IN AN AIR CONDITIONING SYSTEM

(75) Inventors: Nobuo Ichimura, Gunma (JP); Yoshikazu Takamatsu, Tochigi (JP); Yoshitoshi Noda, Tochigi (JP); Akira Tsukamoto, Tochigi (JP); Mitsutoshi Sugano, Tochigi (JP); Yoshihiro Nakamura, Tochigi (JP)

(73) Assignees: Calsonic Kansei Corporation, Tokyo (JP); Calsonic Products, Inc., Sano (JP)

( * ) Notice: Subject to any disclaimer, the term of this patent is extended or adjusted under 35 U.S.C. 154(b) by 0 days.

(21) Appl. No.: 10/028,975

(22) Filed: Dec. 28, 2001

(65) Prior Publication Data

US 2003/0121278 A1 Jul. 3, 2003

(51) Int. Cl.[7] ..... F25B 43/00
(52) U.S. Cl. ..... 62/474; 96/117.5; 96/134
(58) Field of Search ..... 62/474, 503, 509; 96/108, 117.5, 134, 139, 147

(56) References Cited

U.S. PATENT DOCUMENTS

| | | | | | |
|---|---|---|---|---|---|
| 32,092 | A | * | 4/1861 | Davis | 62/509 |
| 3,755,994 | A | * | 9/1973 | Bidiwala | 96/108 |
| 3,759,062 | A | * | 9/1973 | Wrenn et al. | 62/474 |
| 4,758,366 | A | | 7/1988 | Parekh | 252/68 |
| 5,038,582 | A | * | 8/1991 | Takamatsu | 62/474 |
| 5,159,821 | A | * | 11/1992 | Nakamura | 165/110 |
| 5,179,780 | A | * | 1/1993 | Wintersteen et al. | 29/422 |
| 5,375,327 | A | * | 12/1994 | Searfoss et al. | 62/474 |
| 5,596,882 | A | * | 1/1997 | Hutchison et al. | 29/890.06 |
| 5,694,782 | A | * | 12/1997 | Alsenz | 62/156 |
| 5,979,224 | A | * | 11/1999 | Cavestri | 73/40.7 |
| 6,000,465 | A | * | 12/1999 | Kawahara | 165/132 |
| 6,189,333 | B1 | * | 2/2001 | Cummings et al. | 62/474 |
| 6,330,810 | B1 | * | 12/2001 | Yamazaki et al. | 62/474 |

FOREIGN PATENT DOCUMENTS

| | | | | |
|---|---|---|---|---|
| EP | 0 666 456 A1 | * | 8/1995 | F25B/43/00 |
| JP | 61-211391 | | 9/1986 | |
| JP | 5-52665 | | 7/1993 | |
| JP | 7-180930 | | 7/1995 | |
| JP | 9-324962 | | 12/1997 | |
| JP | 410073346 A | * | 3/1998 | F25B/43/00 |
| JP | 02002054862 A | * | 2/2002 | F25B/43/00 |

* cited by examiner

*Primary Examiner*—William E. Tapolcai
*Assistant Examiner*—Mohammad M. Ali
(74) *Attorney, Agent, or Firm*—Foley & Lardner LLP

(57) ABSTRACT

The invention relates to a receiver-drier for use in an air conditioning system. This receiver-drier has (a) a lower portion defining a lower chamber in the receiver-drier; (b) an upper portion defining an upper chamber in the receiver-drier; and (c) a strainer for removing foreign particles from the refrigerant. The lower portion has an inlet for allowing the refrigerant to flow into the lower chamber and an outlet for allowing the refrigerant to flow out of the lower chamber. Each of the inlet and the outlet is formed at a bottom of the lower portion. The upper chamber is on top of the lower chamber and is charged with a desiccant for removing moisture from the refrigerant. The strainer is disposed at a position in a flow of the refrigerant from the inlet to the outlet.

33 Claims, 19 Drawing Sheets

RECEIVER-DRIER FOR USE IN AN AIR CONDITIONING SYSTEM

BACKGROUND OF THE INVENTION

The present invention relates to a receiver-drier (liquid tank) for use in an air conditioning system, particularly in an automotive air conditioning system. This receiver-drier has basic functions of storing the refrigerant, separating gas and liquid, and removing foreign particles (contaminants) and moisture therefrom. A receiver-drier in an automotive air conditioning system is disposed in an engine room, which is densely packed with many parts. Therefore, it is preferable to provide a receiver-drier with small size, light weight and reduced (simplified) tubing.

Japanese Utility Model Unexamined Publication JP-U-5-52665 discloses a receiver-drier having upper and lower chambers divided by a desiccant layer. In the case of this receiver-drier, refrigerant enters into the upper chamber through inlet, then passes through the desiccant layer, and then accumulates in the lower chamber. The accumulated refrigerant is discharged from outlet through an inner central pipe. This receiver-drier has a feature that the refrigerant introduced into the receiver-drier necessarily passes through the desiccant layer.

SUMMARY OF THE INVENTION

It is an object of the present invention to provide a receiver-drier capable of providing improvement in air conditioning performance.

According to the present invention, there is provided a receiver-drier for use in an air conditioning system. This receiver-drier comprises:

a lower portion defining a lower chamber in said receiver-drier, said lower portion having an inlet for allowing a refrigerant of said air conditioning system to flow into said lower chamber and an outlet for allowing said refrigerant to flow out of said lower chamber, each of said inlet and said outlet being formed at a bottom of said lower portion;

an upper portion defining an upper chamber in said receiver-drier, said upper chamber being on top of said lower chamber and being charged with a desiccant for removing moisture from said refrigerant; and a strainer for removing foreign particles from said refrigerant, said strainer being disposed at a position in a flow of said refrigerant from said inlet to said outlet.

DETAILED DESCRIPTION

Figure 1:
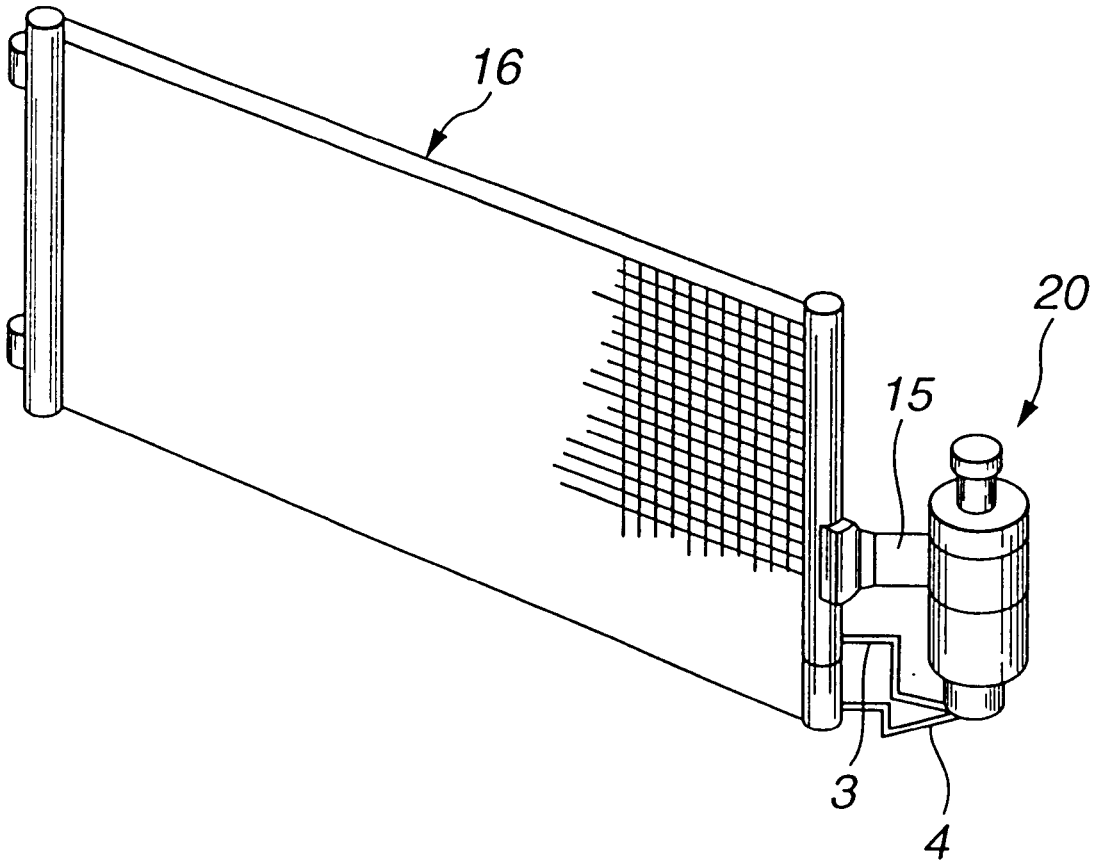
FIG. 1 is a perspective view showing a condenser connected with a receiver-drier according to the present invention.

According to the above-mentioned Japanese Utility Model Unexamined Publication JP-U-5-52665, the receiver-drier is configured such that the refrigerant is necessarily forced to pass from the upper chamber to the lower chamber through the desiccant layer in order to sufficiently remove moisture from the refrigerant. In contrast, a receiver-drier according to the invention comprises a lower chamber for introducing thereinto the refrigerant through its inlet and an upper chamber (on top of the lower chamber) charged with a desiccant. The inventors unexpectedly found that this receiver-drier is capable of improving air conditioning performance. In fact, this receiver-drier is capable of smoothly guiding the liquid refrigerant (accumulated in the interior of the receiver-drier) to the outlet due to the reduced flow resistance in the receiver-drier, while it is capable of exhibiting proper functions (e.g., storage of refrigerant, separation of gas and liquid, and removal of foreign particles and moisture) required of a normal receiver-drier of in air conditioning systems. Furthermore, it is possible to significantly simplify the production procedure and to reduce the production cost of receiver-drier As is seen from FIG. 1, a first receiver-drier 20 according to a first embodiment of the present invention is fixed to a housing of a condenser 16 through a fixing bracket 15 in an air conditioning system. This condenser 16 is provided with a supercooling function. Thus, a condensed refrigerant (a gas-liquid mixture) from the condenser 16 is allowed to flow into the receiver-drier 20 through an inlet pipe 3. Then, the refrigerant out of the receiver-drier 20 through an outlet pipe 4 is cooled again in a supercooling section of the condenser to make the refrigerant in the form of liquid.

Figure 2:
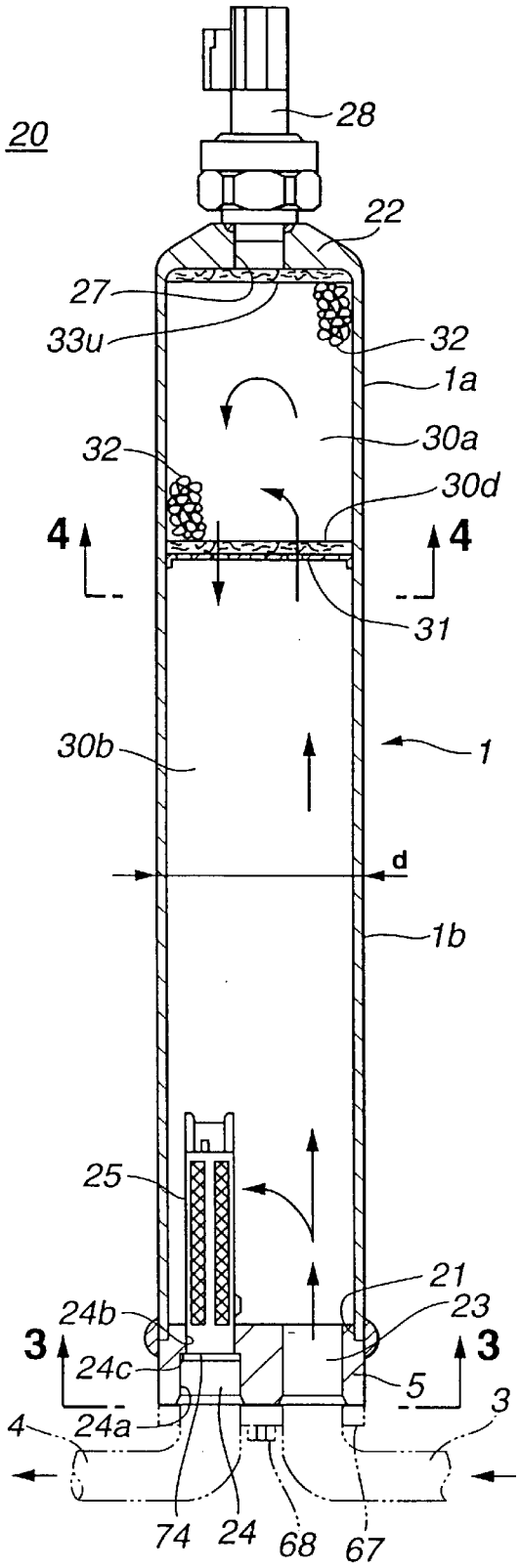
FIG. 2 is a sectional view showing a first receiver-drier according to the present invention.

As is seen from FIG. 2, the first receiver-drier 20 does not have the inner central pipe of Japanese Utility Model Unexamined Publication JP-U-5-52665. Therefore, it is possible to make the receiver-drier thinner in thickness to have a diameter "d". The first receiver-drier 20 includes a cylindrical tank proper 1 having an upper portion 1*a* and a lower portion 1*b*, and a block 5 for closing a bottom opening 21 of the tank proper 1. The tank proper 1 and the block 5 are each made of a material (e.g., aluminum), which is light in weight and relatively easy in shaping. The block 5 is fixed to the tank proper 1, for example, by MIG welding. The tank proper 1 has a cylindrical wall that is straight in shape from the bottom opening 21 to a top portion 22. Therefore, the receiver-drier 20 occupies only a relatively small space, and it becomes easy to attach the receiver-drier 20 to a side portion of the condenser 16. The top portion 22 of the tank proper 1 is formed with an opening 27 having a threaded wall, with which a pressure sensor 28 is threadedly engaged. The pressure sensor 28 serves to sense pressure of the inside of the tank proper 1 and in turn pressure on a high-pressure side of the refrigerating cycle.

When the pressure sensor 28 senses an abnormal high pressure in the refrigerating cycle, operation of the compressor (not shown in the drawings) is stopped, thereby protecting the refrigerating cycle from such abnormal high pressure. In contrast, when the pressure sensor 28 senses an abnormal low pressure in the refrigerating cycle, it is indicative that the refrigerant is in shortage due to refrigerant leak and that the outside temperature is too low. Therefore, operation of the compressor is also stopped, thereby preventing seizure of the compressor. The pressure sensor 28 includes a pressure switch for outputting a predetermined signal in response to the sensed pressure.

Figure 3:
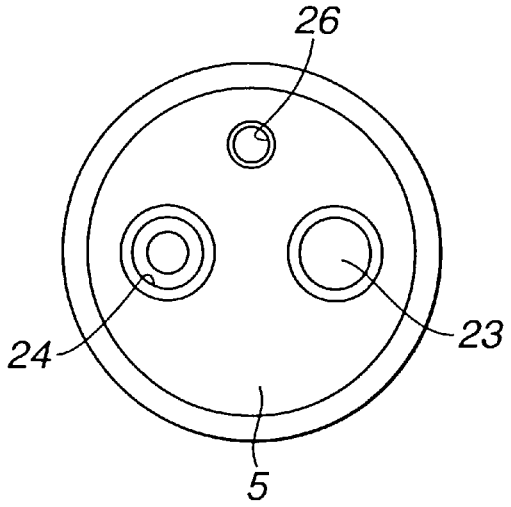
FIG. 3 is a sectional view taken along lines 3—3 of FIG. 2.
Figure 4:
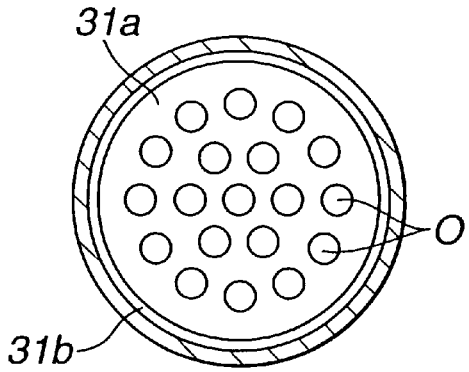
FIG. 4 is a sectional view taken along lines 4—4 of FIG. 2.

As shown in FIGS. 2 and 3, the block 5 is formed with an inlet 23 and an outlet 24 that are spaced from each other. The inlet 23 serves to allow the refrigerant to flow into the lower chamber 30*b*, and the outlet 24 serves to allow the refrigerant to flow out of the lower chamber 30*b*. Each of the inlet 23 and the outlet 24 is substantially cylindrical in shape and has an axis that is parallel with that of the tank proper 1. The inlet 23 and the outlet 24 are respectively connected with the inlet pipe 3 and the outlet pipe 4. The refrigerant is allowed to upwardly flow into the lower chamber 30*b* through the inlet 23, since the inlet is directed in an upward direction. Thus, when the refrigerant is introduced in the form of a gas-liquid mixture, the gaseous refrigerant is emitted in an upward direction. In contrast, the liquid refrigerant accumulates in a lower part of the lower chamber 30*b*. Since the outlet 24 is also provided at the bottom of the lower chamber 30*b*, it becomes easy to guide only the liquid refrigerant into the outlet pipe 4 out of the lower chamber 30*b*. In other words, it is easy to conduct a gas-liquid separation by the above construction of the receiver-drier 20.

As stated above, the receiver-drier 20 does not have the above-mentioned inner central pipe of Japanese Utility Model Unexamined Publication JP-U-5-52665. Therefore, even if the block 5 is made small to have a diameter of "d", it becomes possible to respectively connect the inlet pipe 3 and the outlet pipe 4 with the inlet 23 and the outlet 24 in a way that the inlet pipe 3 and the outlet pipe 4 do not become an obstacle to each other. Furthermore, the inlet 23 and the outlet 24 are substantially cylindrical in shape to have a straight axis. Therefore, it is easy to form the inlet 23 and the outlet 24 in the block 5 by machining.

The inlet pipe 3 serves to allow the refrigerant out of the condenser 16, which is generally in the form of a gas-liquid mixture, to flow into the lower chamber 30*b* through the inlet 23. The outlet pipe 4 serves to guide the refrigerant (gas refrigerant or liquid refrigerant accumulated in the lower chamber 30*b*) to the supercooling section of the condenser 16. It is, however, needless to say that a receiver-drier according to the present invention can be installed in an air conditioning system having a condenser free of a supercooling section. In this case, the outlet pipe 4 is connected with expansion valve, then evaporator, then compressor, and then condenser of the air conditioning system in order to form the refrigerating cycle.

As shown in FIG. 3, the block 5 is further formed with a threaded hole 26. As will be described hereinafter, a fixing bracket 67 (see FIGS. 10 and 11) for fixing the inlet pipe 3 and the outlet pipe 4 is attached to the block 5 by threadedly engaging a bolt 68 with the threaded hole 26.

As is seen from FIG. 2, a strainer 25 for removing foreign particles (e.g., metal contaminants) is detachably attached to the outlet 24. In operation, there may occurs a refrigerant bypass flow (a direct flow from the inlet 23 to the outlet 24) bypassing the upper chamber 30*a*. Therefore, the strainer 25 can be provided at the outlet 24, and this makes it possible to remove foreign particles contained in such bypass flow and to prevent clogging of the strainer 25. In fact, this strainer 25 provided on the outlet side accumulates foreign particles on the outside of the strainer 25. Thus, this strainer 25 is superior in filtering performance and improved in lifetime. Although not shown in the drawings, it is optional to form the strainer 25 at the inlet 23 or to form first and second strainers at the inlet 23 and the outlet, respectively. It is possible to attach or detach the strainer 25 through the outlet 24 or the inlet 23 without providing a hole special to this attachment or detachment. Therefore, it is possible to reduce the production cost of the receiver-drier. Construction of the strainer 25 will be described in detail hereinafter.

Figure 5:
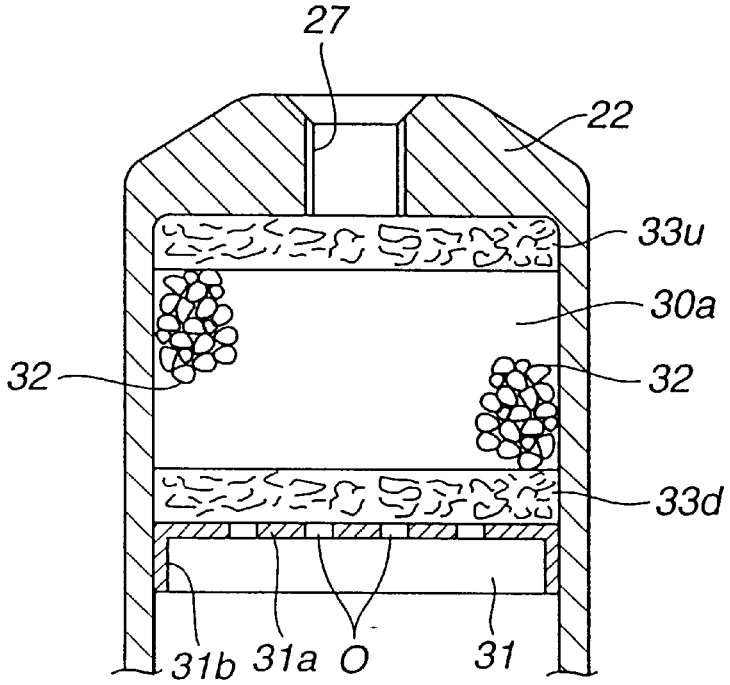
FIG. 5 is an enlarged partial view showing the first receiver-drier of FIG. 2.

As shown in FIGS. 2 and 5, the upper chamber 30*a* is charged or filled with a desiccant 32 in the form of grains or pellets in order to remove (by adsorption) moisture contained in the refrigerant (a gas-liquid mixture) introduced from the inlet pipe 3. Although not shown in the drawings, the upper chamber 30*a* is fully charged with the desiccant grains 32. The charged desiccant grains 32 are interposed between upper and lower filters (cushions) 33*u* and 33*d*. The upper filter 33*u* is disposed under the bottom surface of the top portion 22 of the receiver-drier 20. Furthermore, there is provided a supporting member 31 at a predetermined position for supporting thereon the desiccant grains 32 and the upper and lower filters 33*u* and 33*d*. The supporting member 31 has (a) a disk portion 31*a* formed with a plurality of through holes "O" and (b) a cylindrical side wall portion 31*b* extending from the periphery of the disk portion 31*a* in a downward direction. Therefore, the supporting member 31 has a section that is inverse-U in shape. The supporting member 31 is fixed to the inner surface of the tank proper 1. The procedure of fixing the supporting member 31 will be described in detail hereinafter. A partition (i.e., a combination of the supporting member 31 and the lower filter 33*d*) serves to separate the lower and upper chambers from each other. As mentioned above, this partition has a structure to allow the refrigerant to flow from the lower chamber 30*b* to the upper chamber and vice versa (see arrows shown in FIG. 2).

The desiccant grains 32 of the upper chamber 30*a* are made of silica gel, synthetic zeolite or the like and may have a particle diameter of about 1.4 mm. Each of the upper and lower filters 33*u* and 33*d* may be made of glass wool or felt. The upper filter 33*u* has a function of preventing the desiccant grains 32 from reaching the pressure sensor 28 through the opening 27. The lower filter 33*d* serves as a cushioning member for preventing the desiccant grains 32 from breaking into fractions by vibration.

As shown in FIG. 2, the upper chamber 30*a* charged with the desiccant grains 32 is positioned between the top portion 22 of the tank proper 1 and the supporting member 31. In other words, the receiver-drier 20 has a unique structure that is different from a conventional structure in which a desiccant chamber is sandwiched between upper and lower chambers (see JP-U-5-52665). That is, the receiver-drier 20 is free of another major chamber (above the upper chamber 30*a*) for receiving or storing the refrigerant coming out of the desiccant chamber. Therefore, there is no occurrence that the amount of the refrigerant circulating in the refrigerating cycle becomes insufficient due to the accumulation of a large amount of the refrigerant in the another chamber. It should be noted that the opening 27 does not fall under the another major chamber, since the opening 27 has a very small volume. In other words, the top portion 22 has a construction such that the refrigerant is substantially prevented from flowing from the upper chamber 30*a* in an upward direction.

Figure 6:
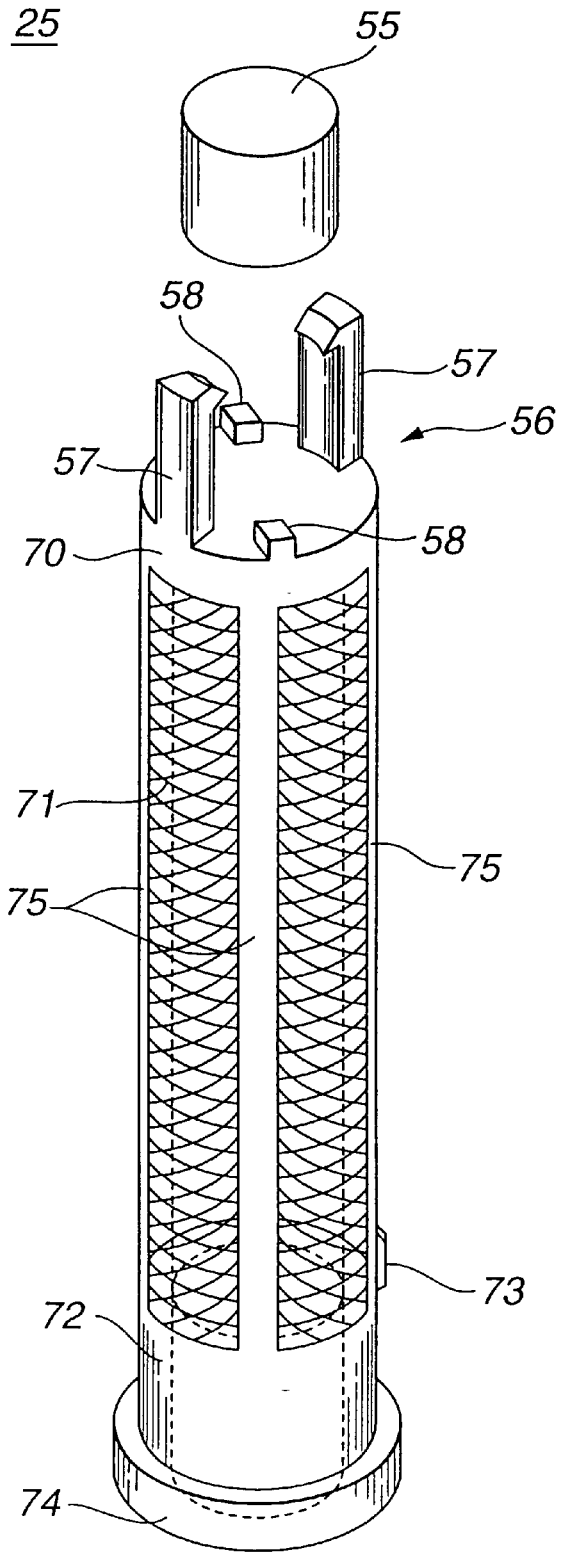
FIG. 6 is a perspective view showing a first strainer according to the present invention.
Figure 7:
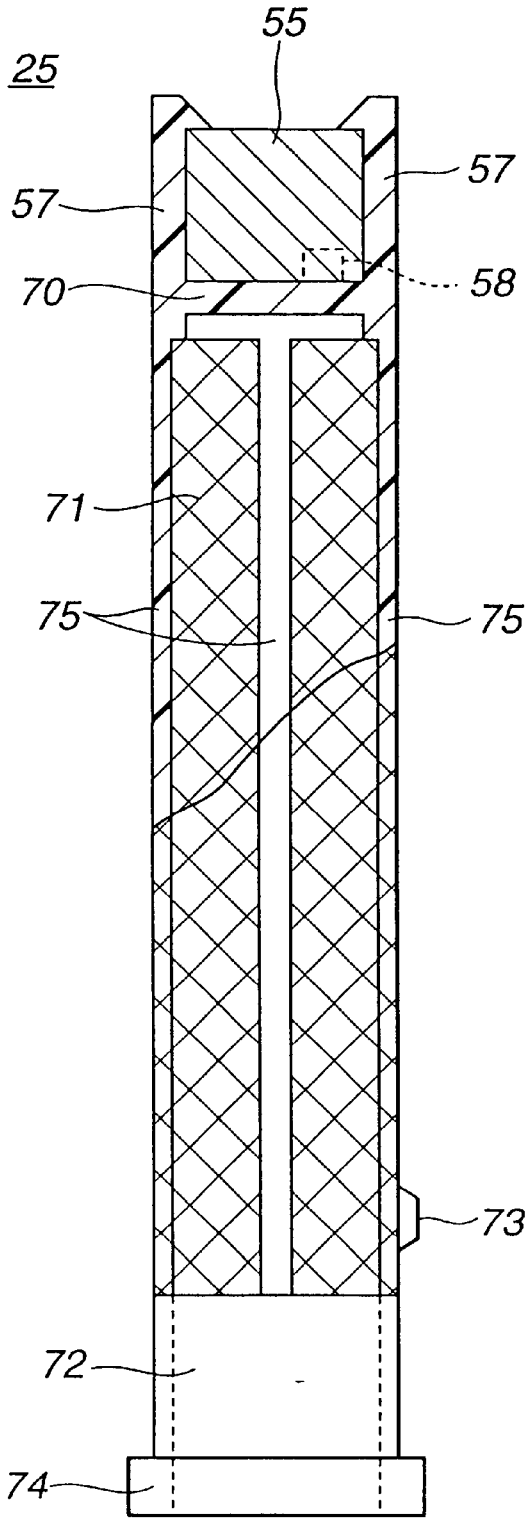
FIG. 7 is a sectional view showing the first strainer of FIG. 6.

As shown in FIGS. 6 and 7, the strainer 25 is a meshed cylindrical member having a rigidity such that the strainer 25 does not deform by the pressure of the refrigerant flowing toward the outlet 24. The strainer 25 has a cylindrical head portion 70, a cylindrical net portion 71 and a base portion 72. The strainer 25 further has a plurality of supports 75 (four supports in the embodiment of FIGS. 6 and 7) extending between the head portion 70 and the base portion 72. The strainer 25 is made of a resin material. The strainer 25 can be produced by shaping a flat net into a cylindrical form, then by putting the cylindrical net into a resin mold, and then by conducting an insert molding to produce the strainer 25, that is, an integral (monolithic) member of the head portion 70, the net portion 71, the base portion 72 and the supports 75. The net portion 71 has, for example, a mesh size number of about 110 to collect foreign particles contained in the refrigerant.

In order to hold the strainer 25 at a proper position in the receiver-drier 20, the strainer 25 is formed with a projection 73 and a flange 74 as a holding mechanism. The projection 73 projects from the support 75 in an outward radial direction. The strainer 25, which is made of a resin material, has a certain flexibility to allow its deformation. During insertion of the strainer 25 into the outlet 24 of the block 5, the support 75 having thereon the projection 73 is thus slightly bent due to abutment of the projection 73 with the inner wall surface of the outlet 24. Thus, it is possible to smoothly insert the strainer 25 into the outlet 24 until a predetermined position. Upon completion of this insertion, the strainer 25 regains its original shape, and the projection 73 takes a position above the top surface of the block 5 (see FIG. 2). Therefore, it is possible to prevent the strainer 25 from falling down from the outlet 24, due to an abutment engagement of the projection 73 with the top surface of the block 5. Furthermore, the force of this abutment engagement is designed such that the strainer 25 can be removed for its replacement without using a special device.

The flange 74 is formed at the bottom of the base portion 72 of the strainer 25 to have a diameter somewhat larger than that of the rest of the strainer 25. As is seen from FIG. 2, the block 5 is formed at its outlet 24 with a stepped portion 24*c* between a larger diameter opening 24*a* and a smaller diameter opening 24*b*. Therefore, the flange 74 of the strainer 25 is in a fitting engagement with the stepped portion 24*c*. With this, further insertion of the strainer 25 is stopped.

In addition to or as an alternative to the above-mentioned holding mechanism (i.e., the projection 73 and the flange 74) of the strainer 25, the base portion 72 can be designed to have a diameter slightly greater than that of the smaller diameter opening 24*b*. With this, the base portion 72 can be pressed into the smaller diameter opening 24*b* to hold the strainer 25 at a proper position with a certain force. This force can be designed to the extent that the strainer 25 is prevented from falling down from the receiver-drier 20 during transportation and that the strainer 25 can be removed for replacement without using a special device.

As shown in FIGS. 6 and 7, the strainer 25 has a fluorescent dye 55 for detecting refrigerant leak of the air conditioning system. The strainer 25 is formed with a holder 56 for holding the fluorescent dye 55 on the top surface of the head portion 70. This holder 56 has (a) a pair of flexible arms 57 extending from the top surface of the head portion 70 in a direction along the axis of the receiver-drier and (b) a pair of projections 58 having a height lower than that of the arms 57. These arms 57 are arranged at diametric positions about the axis of the receiver-drier 20 and are spaced from each other by a distance such that the fluorescent dye 55 can be securely held between the arms 57. The projections 58 are formed on the top surface of the head portion 70 such that the projections 58 do not become an obstacle to removal of sliding molds for producing the strainer 25. Each arm 57 has a pawl 57*a* that is spaced from the top surface of the head portion 70 by a distance such that the fluorescent dye 55 can be securely held between this top surface and the pawl 57*a*. The fluorescent dye 55 can be pressed into a space defined by the arms 57 and the projections 58 in a snap action manner, since the arms 57 are provided with flexibility. With this, the fluorescent dye 55 is prevented from falling from the strainer 25 and into the inlet 23.

The fluorescent dye 55 is in the form of solid having a cylindrical shape and can be prepared by impregnating a felt material (e.g., polyester) with a fluorescent dye (liquid). When the fluorescent dye is mixed with lubricating oil, it decomposes into fine particles (e.g., not greater than 19 m in particle diameter). Then, these fine particles circulate in the refrigerating cycle together with refrigerant and lubricating oil. This lubricating oil is contained in the refrigerant for maintaining lubrication of sliding parts (e.g., compressor) of the air conditioning system. The time required to exhibit the luminescence function (upon irradiation with ultraviolet rays) through dissolution of the fluorescent dye in the lubricating oil is a short time such as 3–4 minutes. Exemplary fluorescent dyes are xanthene compounds and perylene compounds, which are disclosed in U.S. Pat. No. 4,758,366 corresponding to Japanese Patent Unexamined Publication JP-A-61-211391.

Figure 8A:
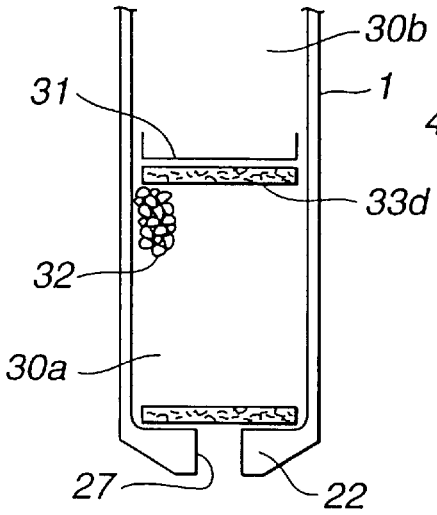
FIGS. 8(A)–8(C) are sectional views showing sequential steps for fixing a supporting plate (used for supporting desiccant grains) at a predetermined position.
Figure 8B:
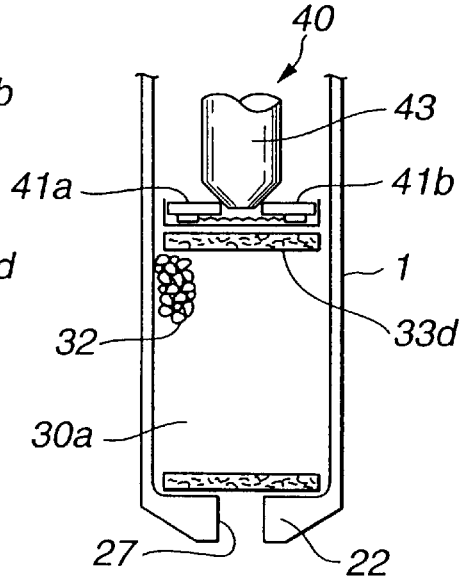
Figure 9:
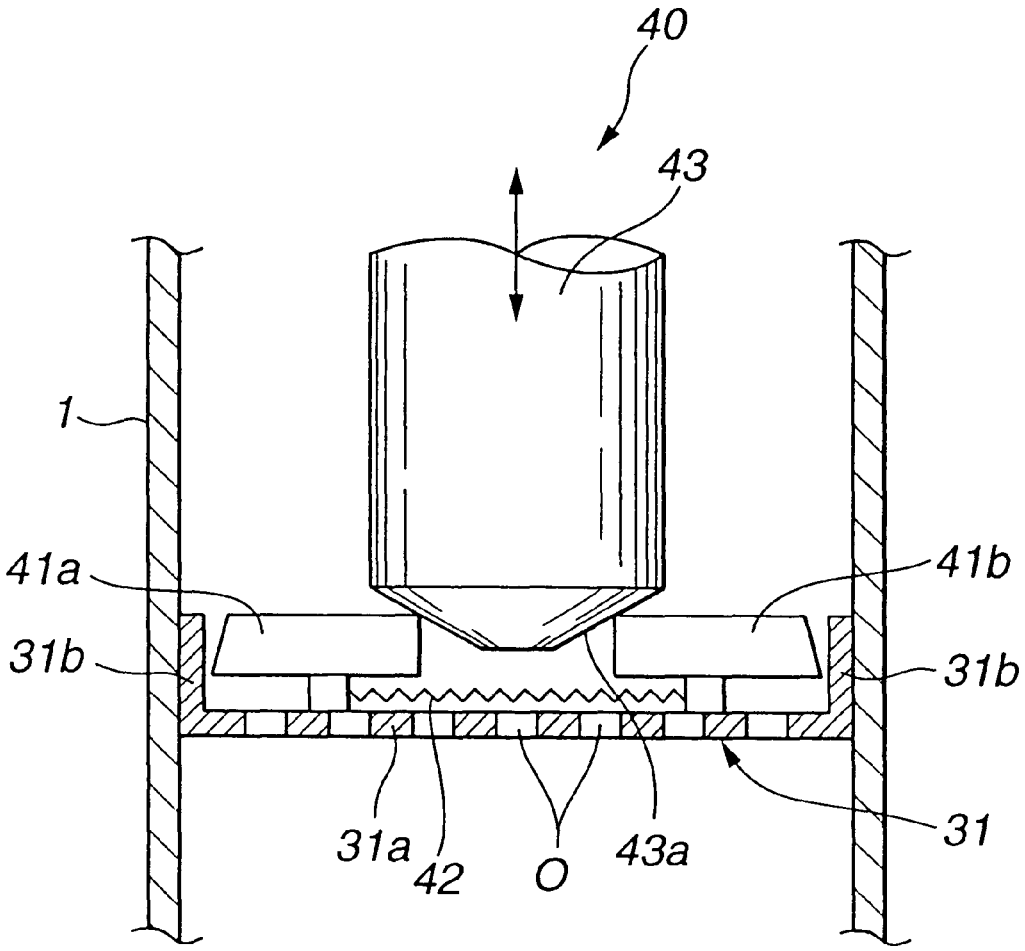
FIG. 9 is a partial enlarged view of FIG. 8(B)

An exemplary method for producing the receiver-drier 20 is explained in the following. At first, as shown in FIG. 8(A), the tank proper 1 is disposed upside down. Then, the upper filter 33*u* is placed on the surface of the top portion 22. Then, a suitable amount of the desiccant grains 32 is put into the tank proper 1, followed by placement of the lower filter 33*d* on the desiccant grains accumulated in the tank proper 1. Then, as shown in FIGS. 8(B) and 9, the supporting member 31 is placed on the lower filter 33*d* by pressing the supporting member 31 into the tank proper 1. After that, the supporting member 31 is securely fixed to the tank proper by staking (caulking) using a staking (caulking) jig 40 such that the upper filter 33*u*, the desiccant grains 32 and the lower filter 33*d* are safely supported by the supporting member 31. Herein, the staking jig 40 is not particularly limited, as long as it makes the cylindrical side wall 31*b* of the supporting member 31 protrude outwardly. As an example, the staking jig 40 has a plurality of punch members 41*a* and 41*b* that are biased by a spring member 42 in an inward radial direction to allow a sliding movement of the punch members 41*a* and 41*b* in a radial direction. The staking jig 40 further has a rod member 43 for expanding the punch members 41*a* and 41*b* in an outward radial direction. The rod member 43 is positioned at a center between the punch members 41*a* and 41*b* in a radial direction and is movable in a direction along the axis of the receiver-drier 20. The rod member 43 is formed at its bottom into a truncated cone shape.

The staking of the supporting member 31 is conducted as follows. At first, the rod member 43 is moved downward from an inoperative starting position toward the supporting member 31 by hydraulic pressure or the like until inclined surfaces 43*a* are brought into abutment with the respective inner edges of the top surfaces of the punch members 41*a* and 41*b*, as shown in FIG. 9. As the rod member 43 is further moved in a downward direction, the punch members 41*a* and 41*b* are simultaneously expanded in an outward radial direction until the cylindrical side wall portion 31*b* of the supporting member 31 is firmly pressed against the tank proper 1 to achieve staking. With this, the supporting member 31 is fixed to the tank proper 1. Such staking can be conducted over the entire periphery of the cylindrical side wall portion 31*b*.

Alternatively, the staking can be conducted only for certain positions in the periphery of the cylindrical side wall portion 31*b* to the extent that the supporting member 31 is fixed to the tank proper 1 with a sufficient strength. In this case, it is allowed to have a gap (less than the particle diameter of the desiccant grains 32) between the cylindrical side wall portion 31*b* and the corresponding inner surface of the tank proper 1.

After completion of the staking, the rod member 43 is moved upward to the inoperative starting position. With this, the punch members 41*a* and 41*b* are moved simultaneously in an inward radial direction by the spring force of the spring member 42. After that, the staking jig 40 is taken out of the inside of the tank proper 1.

Figure 8C:
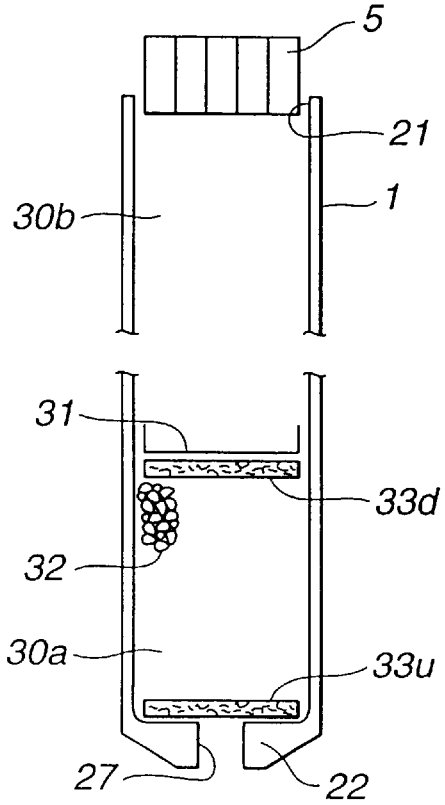

Then, as shown in FIG. 8(C), the supporting member 31 is securely fixed to the tank proper 1 by MIG welding under a condition that the opening 21 of the tank proper 1 is closed by the block 5. The above-mentioned staking of the supporting member 31 is superior to other means (e.g., bonding with adhesive and fixing with screws) in terms of workability, mass production and production cost.

According to a conventional receiver-drier having a desiccant grains chamber interposed between upper and lower major chambers, it is necessary to provide two supporting members and to subject them to staking for the purpose of keeping a mass of the desiccant grains at a proper position. In contrast, the receiver-drier 20 does not have another major chamber above the upper chamber 30*a*. Therefore, it suffices to subject only one supporting member 31 to staking for the purpose of keeping a mass of the desiccant grains 32 at a proper position. This staking is simpler, easier and more effective in the production cost reduction, as compared with that of the above conventional receiver-drier.

Figure 10:
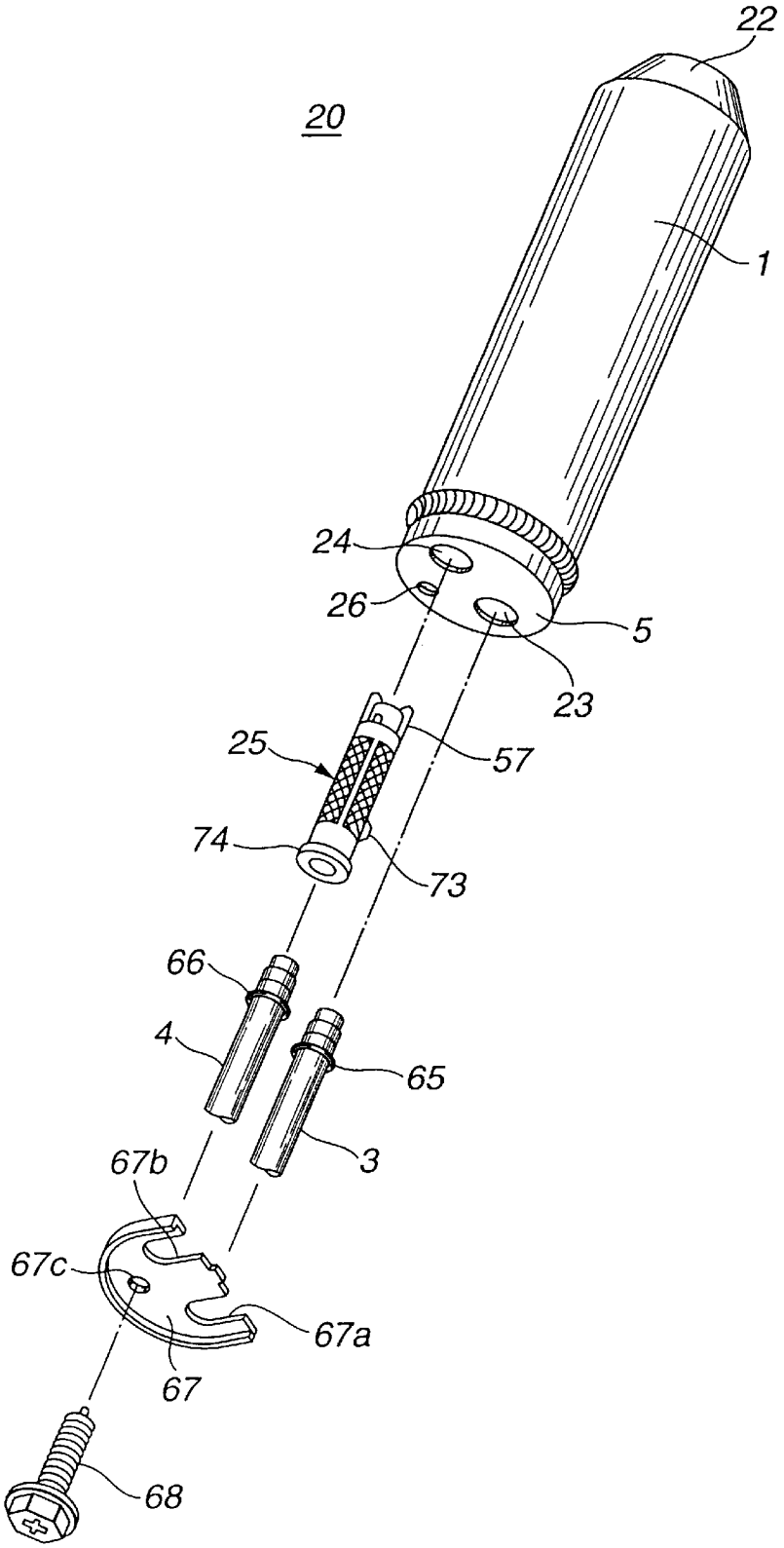
FIG. 10 is a perspective exploded view showing parts of the first receiver-drier of FIG. 2.
Figure 11:
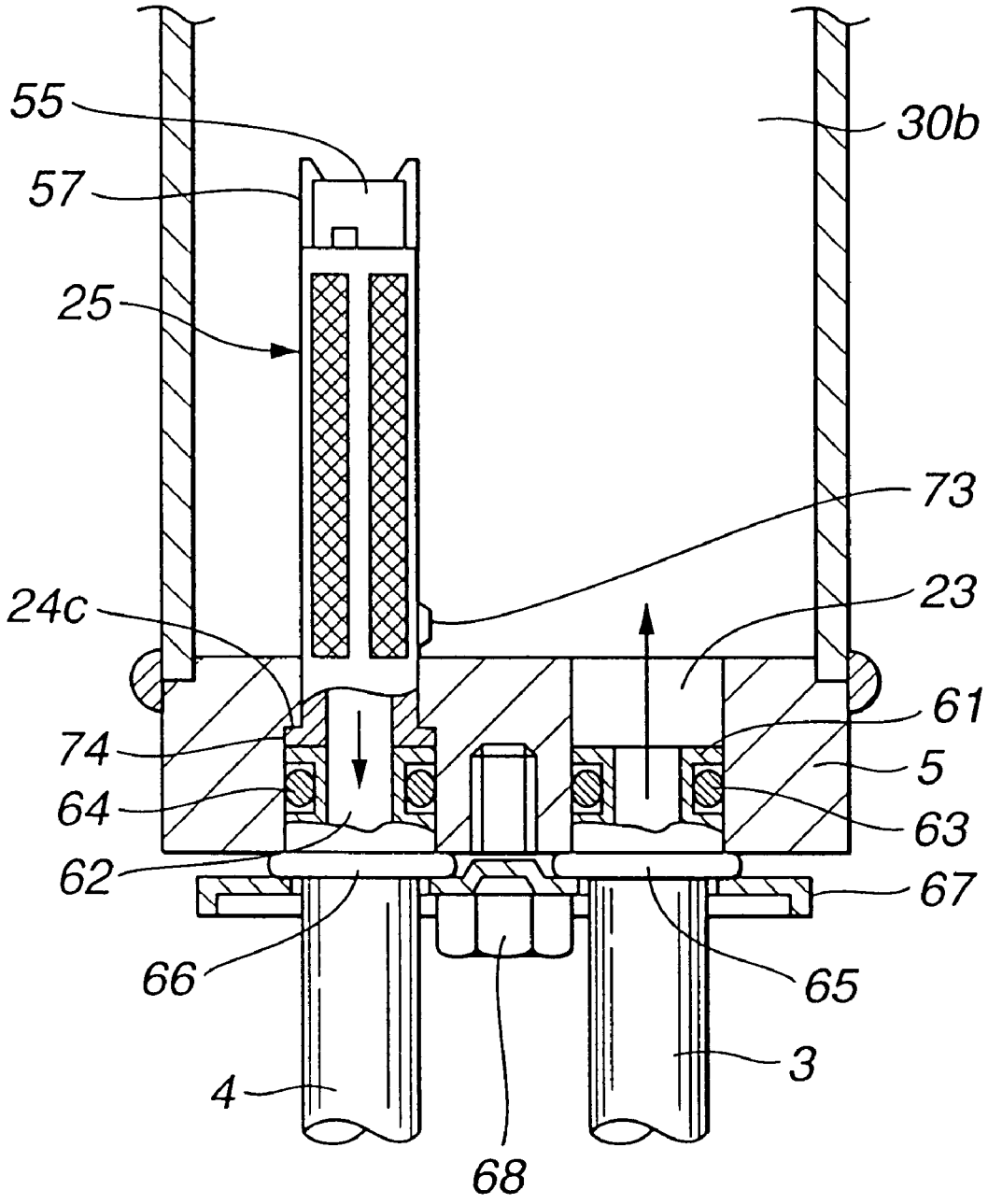
FIG. 11 is an enlarged sectional view showing an assembled condition of the parts of FIG. 10.

Assembly of the strainer 25, the inlet 3 and the outlet 4 is explained in the following. At first, as shown in FIGS. 10 and 11, the fluorescent dye 55 is attached to the strainer 25 by inserting it into a space between the arms 57 and the projections 58. Then, the strainer 25 is inserted into the outlet 24 until the projection 73 passes over the outlet 24 (see FIG. 11). Upon this, the flange 74 is brought into abutment with the stepped portion 24*c* to limit a further insertion of the strainer 25. Under this condition, the strainer 25 is prevented from falling down from the outlet 24 during transportation of the receiver-drier by an abutment engagement with the projection 73 with the top surface of the block 5.

Then, as shown in FIG. 11, an end portion 61 of the inlet pipe 3 is inserted into the inlet 23 until a collar 65 of the inlet pipe 3 abuts against the bottom surface of the block 5. An end portion 62 of the outlet pipe 4 is inserted into the outlet 24 until the top surface of the end portion 62 abuts against the bottom surface of the flange 74 of the strainer 25. Under this condition, the flange 74 is sandwiched between the stepped portion 24*c* and the end portion 62 of the outlet pipe 4 so that the strainer 25 is positioned and held at a proper position shown in FIG. 11. Furthermore, a collar 66 of the outlet pipe 4 is in abutment with the bottom surface of the block 5. The end portions 61 and 62 of the inlet pipe 3 and the outlet pipe 4 are respectively formed at their grooves with O-rings 63 and 64 for providing sealing.

Then, as shown in FIG. 10, a fixing bracket 67, which is generally E-shaped, is attached to the block 5 in order to fix the inlet pipe 3 and the outlet pipe 4 to the block 5, as follows. This fixing bracket 67 has first and second cutout portions 67*a* and 67*b* having respective widths that are wider than the respective widths of the inlet pipe 3 and the outlet pipe 4 and narrower than the respective diameters of the collars 65 and 66 so that the fixing bracket 67 is capable of preventing the inlet pipe 3 and the outlet pipe 4 from coming out of the block 5. The fixing bracket 67 further has a through hole 67*c* for receiving a bolt 68 therethrough. The fixing bracket 67 is attached to the block 5 in a manner to allow the cutout portions 67*a* and 67*b* of the fixing bracket 67 to receive therethrough the inlet pipe 3 and the outlet pipe 4, respectively. Then, the bolt 68 is threadedly engaged with the opening 26 of the block 5 so that the inlet pipe 3 and the outlet pipe 4 are securely fixed to the block 5.

According to need, it is possible to easily detach the strainer 25 from the receiver-drier 20, as explained in the following. The abutting engagement of the projection 73 with the top surface of the block 5 is designed to the extent that the strainer 25 can be detached without using a special device. Therefore, it is possible to easily detach the strainer 25 from the receiver-drier 20 through the outlet 4 by disengaging the bolt 68, then by removing the fixing bracket 67, and then by detaching the outlet pipe 4 from the block 5. Therefore, it is possible to easily conduct a replacement of the strainer 25 with new one in the case of clogging or the like of the strainer 25. Furthermore, the fluorescent dye 55 is disposed in the refrigerating cycle in a manner that the strainer 25 holds it. Therefore, the fluorescent dye 55 can also be renewed when the strainer 25 is replaced with a new one. Therefore, it is possible to maintain the capability to detect refrigerant leak of the air conditioning system for a much longer time, as compared with a case in which the fluorescent dye is stored in a desiccant chamber. In fact, this case makes it almost impossible or at least substantially difficult to renew the fluorescent dye.

In case that the strainer 25 of the receiver-drier 20 is clogged with foreign particles, that the fluorescent dye 55 does not have a proper function, or that the fluorescent dye 55 is not on the strainer 25 by mistake, it is possible to take a suitable measure such as elimination of clogging, a replacement of the fluorescent dye 55 with new one, or installation of the fluorescent dye 55 by replacing only the strainer 25, not the entirety of the receiver-drier 20. Therefore, it is possible to minimize the number of parts for replacement and to omit a waste in parts replacement.

Operation of the receiver-drier 20 is described in the following. When the compressor is energized in an air conditioning system having the receiver-drier 20 installed in its refrigerating cycle, the refrigerant (in the form of a gas-liquid mixture) produced by condensation in the condenser 16 is introduced into the lower chamber 30*b* through the inlet pipe 3 and the inlet 23 of the block 5.

Of the refrigerant introduced into the lower chamber 30*b* through the inlet pipe 3, its gaseous component tends to accumulate in an upper part of the lower chamber 30*b*, the upper part being adjacent to the desiccant chamber 30*a*. In contrast, the liquid refrigerant tends to accumulate in a lower part of the lower chamber 30*b*. Thus, if the introduced refrigerant contains moisture, the desiccant grains 32 of the upper chamber 30*a* physically adsorb moisture contained in the gaseous component, thereby decreasing moisture content of the gaseous component. With this, moisture contained in the liquid refrigerant gradually transfers from the liquid refrigerant to the gaseous component to naturally correct moisture content imbalance between the gaseous component and the liquid refrigerant. Then, the thus transferred moisture is physically adsorbed by the desiccant grains 32 of the upper chamber 30*a*. In this manner, moisture contained in both of the gaseous component (refrigerant gas) and the liquid refrigerant can be gradually sufficiently removed by the desiccant grains 32, even though the liquid refrigerant tends to accumulate in a lower part of the lower chamber 30*b*.

The refrigerant (liquid) accumulated in a lower part of the lower chamber 30*b* pass through the net portion 71 of the strainer 25, upon which foreign particles are removed therefrom, and then flow towards the supercooling section of the condenser 16 through the outlet 24 and the outlet pipe 4.

As stated above, the receiver-drier 20 is free of another major chamber (above the upper chamber 30*a*) for receiving or storing the refrigerant coming out of the desiccant chamber. Therefore, there is no occurrence that the amount of the refrigerant circulating in the refrigerating cycle becomes insufficient, in spite of that the condition requires a greater amount of the refrigerant to flow out of the receiver-drier, due to the accumulation of a large amount of the refrigerant in the another chamber. Thus, the receiver-drier 20 is capable of making the liquid refrigerant thereof smoothly flow towards the evaporator side through the supercooling section of the condenser 16, thereby making the air conditioning system to achieve a desired air conditioning performance.

As stated above, when the fluorescent dye is mixed with lubricating oil, it decomposes into fine particles. Then, these fine particles circulate in the refrigerating cycle together with refrigerant and lubricating oil. Thus, the position of refrigerant leak of the air conditioning system can easily be detected by checking the existence of luminescence by the ultraviolet irradiation using an ultraviolet lamp.

If the fluorescent dye is disposed at a position where a refrigerant containing lubricating oil passes or accumulates, the fluorescent dye easily decomposes. Therefore, the fluorescent dye can be set at a position near the inlet or the outlet of the receiver-drier. In case that the fluorescent dye is attached to a head portion of the strainer, it is preferable to set the fluorescent dye at a position near the outlet from the viewpoint of providing longer lifetime of the strainer. In other words, it is preferable to set the strainer (having the fluorescent dye at its head portion) at the outlet of the receiver-drier.

Figure 12:
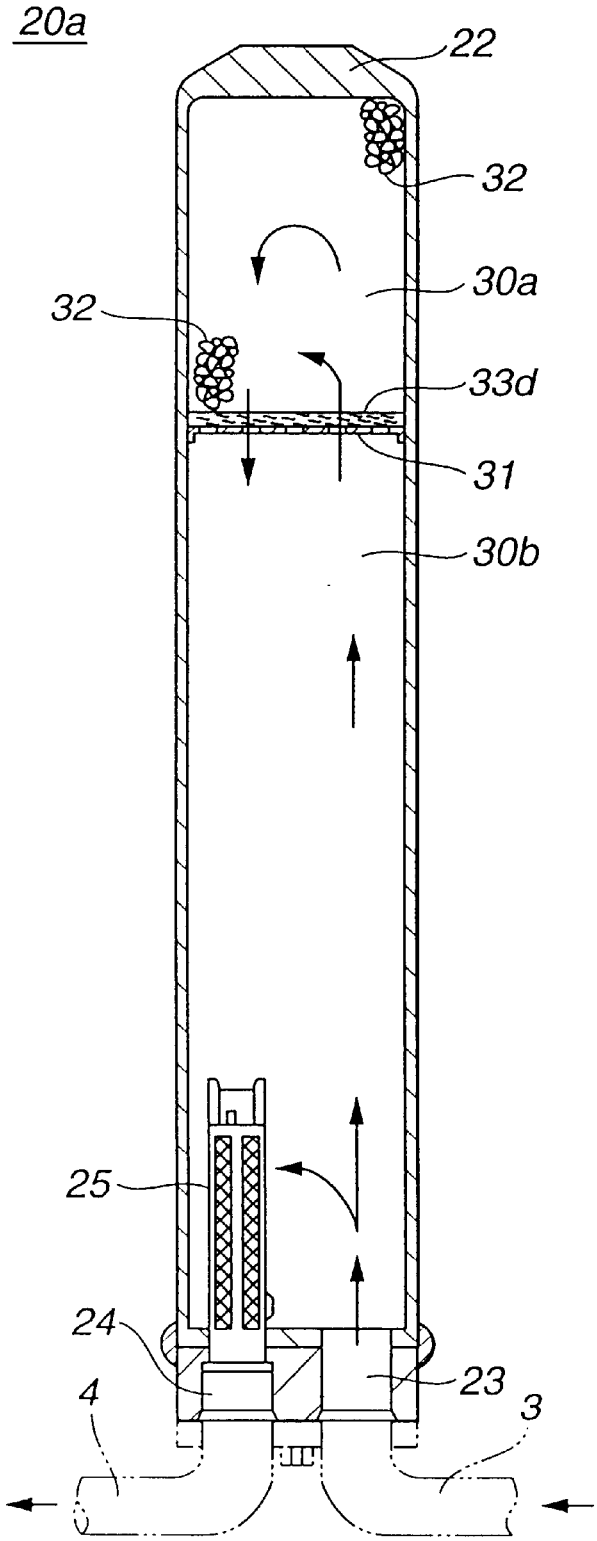
FIGS. 12–13 are views similar to FIG. 2, but respectively showing second and third receiver-driers according to the present invention.

FIG. 12 shows a second receiver-drier 20*a* according to a second embodiment of the present invention, which is a slight modification of the first receiver-drier 20. Therefore, the parts and the constructions of the second receiver-drier 20*a*, which are substantially the same as those of the first receiver-drier 20, are denoted by the same numerals, and their explanations are not repeated in the following. The second receiver-drier 20*a* is free of the pressure sensor 28 and the opening 27 for receiving the same of the first receiver-drier 20. Since the second receiver-drier 20*a* does not require the provision of a means for preventing the desiccant grains 32 from moving into the opening 27, the second receiver-drier 20*a* is free of the upper filter 33*u* of the first receiver-drier 20. As mentioned above, the number of parts of the second receiver-drier 20*a* is less than that of the first receiver-drier 20. Furthermore, the production process of the former is simpler than that of the latter, since the step of putting the upper filter 33*u* is not necessary in the second receiver-drier 20*a*. Therefore, a further production cost reduction is possible in the case of the second receiver-drier 20*a*.

Figure 13:
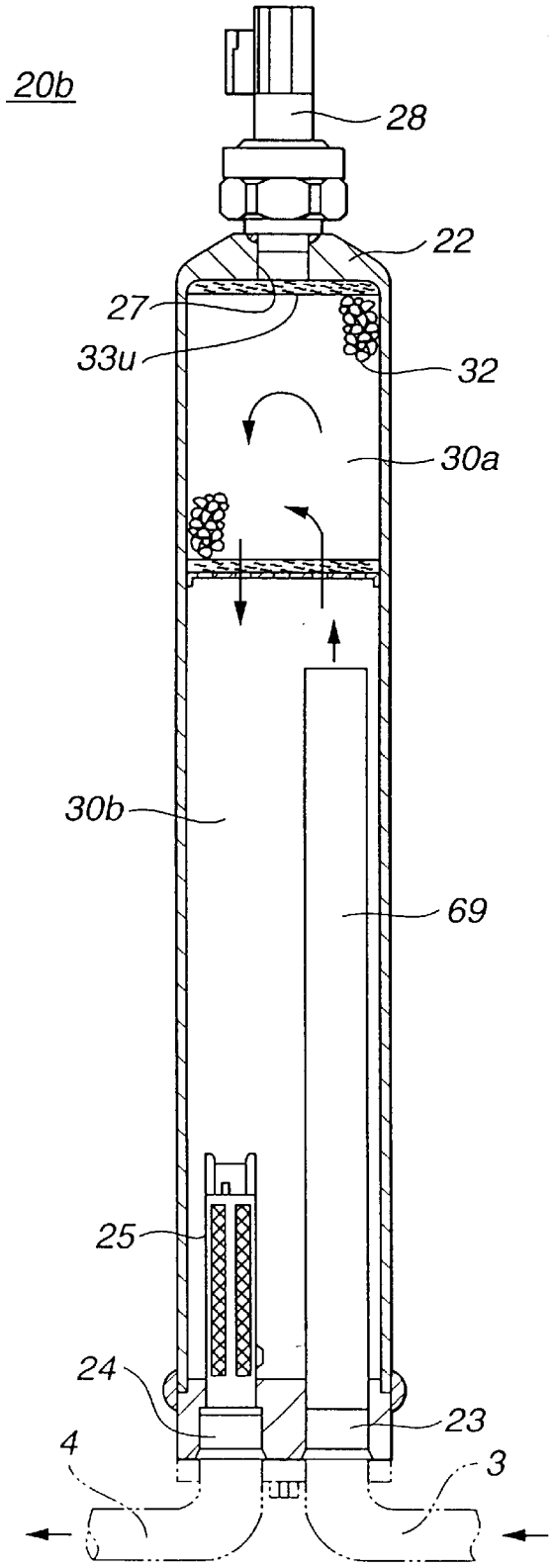

FIG. 13 shows a third receiver-drier 20*b* according to a third embodiment of the present invention, which is a slight modification of the first receiver-drier 20. Therefore, the parts and the constructions of the third receiver-drier 20*b*, which are substantially the same as those of the first receiver-drier 20, are denoted by the same numerals, and their explanations are not repeated in the following. The receiver-drier 20*b* has a guide pipe 69 for guiding the refrigerant from the inlet 23 to the upper chamber 30*a*. This guide pipe 69 extends from the inlet 23 to a position close to the bottom surface of the upper chamber 30*a* towards the upper chamber 30*a*. Therefore, it is possible to smoothly introduce the refrigerant (a gas-liquid mixture) from the inlet pipe 3 into the lower chamber 30*b*, since the introduction of this refrigerant (a gas-liquid mixture) is not impeded by the liquid refrigerant accumulated in the lower chamber 30*b*. Furthermore, it is possible to introduce a refrigerant (having a dynamic pressure and existing close to the upper chamber 30*a*) into the upper chamber 30*a*, thereby improving the refrigerant purification.

Figure 14:
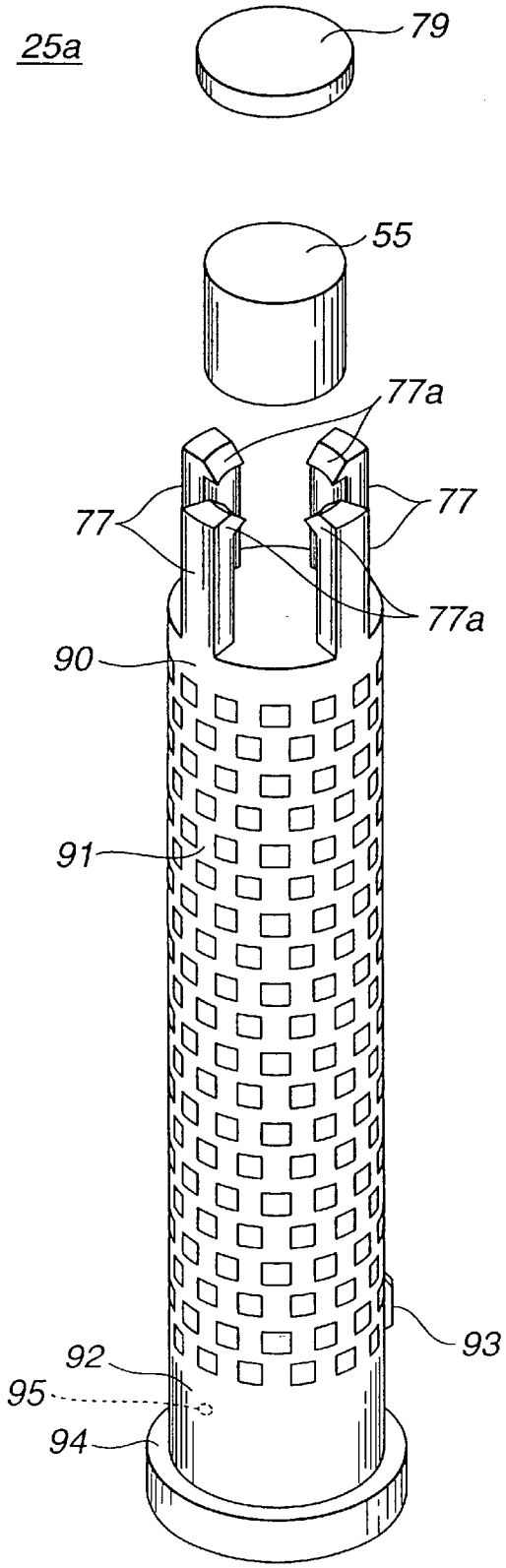
FIG. 14 is a view similar to FIG. 6, but showing a second strainer according to the present invention.
Figure 15:
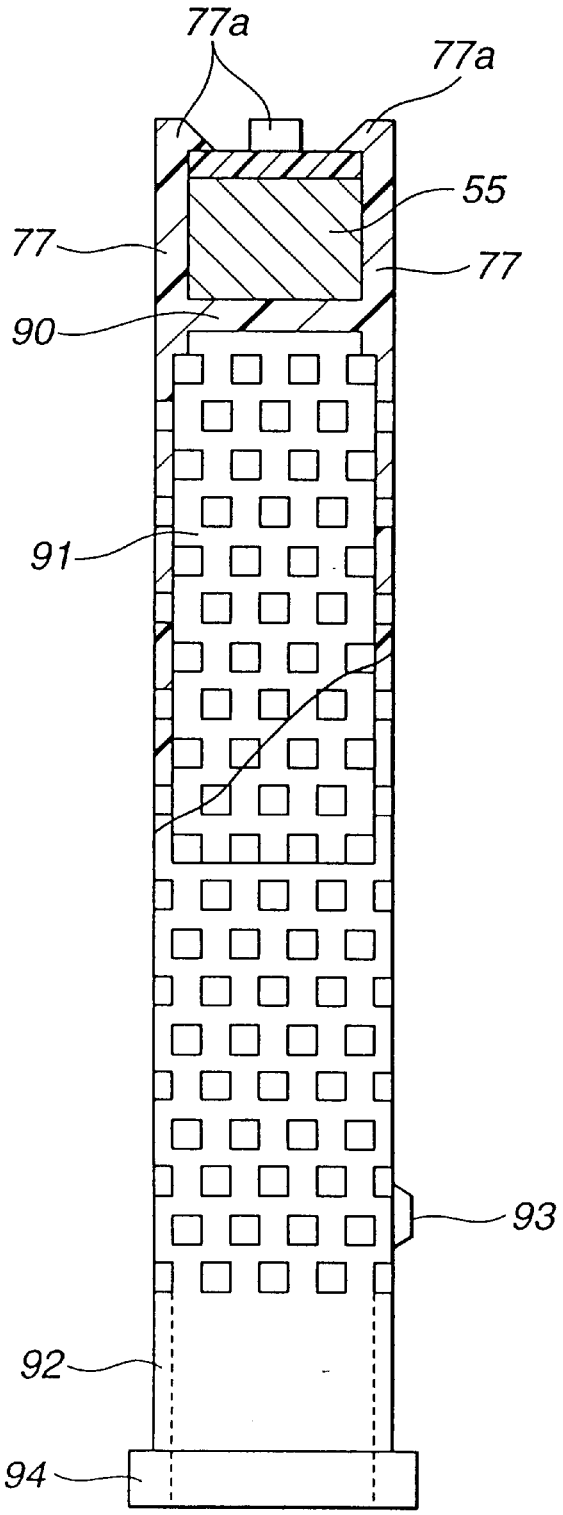
FIG. 15 is a sectional view showing the second strainer of FIG. 14.

FIGS. 14 and 15 show a strainer 25*a* according to an embodiment of the present invention, which is a modification of the strainer 25 shown in FIGS. 6 and 7. The strainer 25*a* is a meshed cylindrical member having a rigidity to resist against pressure of the refrigerant flowing into the outlet 24. The strainer 25*a* also has a cylindrical head portion 90, a cylindrical net portion 91, and a base portion 92. The strainer 25*a* is an integral (monolithic) member made of a resin material. The net portion 91 serves as a support for supporting the head portion 90 on the base portion 92. The net portion 91 has, for example, a mesh size number of about 110 to collect foreign particles contained in the refrigerant. The strainer 25*a* is formed at its net portion 91 with a projection 93 having a function similar to the projection 73 of the strainer 25. Furthermore, the strainer 25*a* is formed at its bottom with a flange 94. As an alternative to or in addition to the projection 93, the strainer 25*a* may have a semispherical projection 95 that projects from a cylindrical surface in an outward radical direction. By the provision of this projection 95, it becomes possible to adjust the depth or strength of pressing insertion of the strainer 25*a*. As a consequence, it becomes easy to set the outer diameter of the base portion 92 of the strainer 25*a* relative to the inner diameter of the smaller diameter opening 24*b* of the outlet 24. In other words, it is not necessary to precisely set the former relative to the latter. This makes the production of the strainer 25*a* easier. Furthermore, it is possible to prevent the strainer 25*a* from being inserted into the block 5 with too much strength and to make an easy detachment of the strainer 25*a*. It is needless to say that the semispherical projection 95 may also be formed on the above-mentioned strainer 25 and the after-mentioned strainers 25*b* and 25*c*.

The strainer 25*a* is formed on the top surface of the head portion 90 with a holder 56 for holding the fluorescent dye 55. This holder 56 has four flexible arms 77 extending upward along the axis of the strainer 25*a* and a cover member 79 for covering the fluorescent dye 55. The opposed two arms 77 are spaced from each other such that the fluorescent dye is fit therebetween. Each arm 77 has a pawl 77*a* that is spaced away from the top surface of the head portion 90 such that a laminate of the fluorescent dye 55 and the cover member 79 is fit between the pawl 77*a* and the top surface of the head portion 90. Thus, the fluorescent dye is prevented from falling down from the strainer 25*a*.

Figure 16:
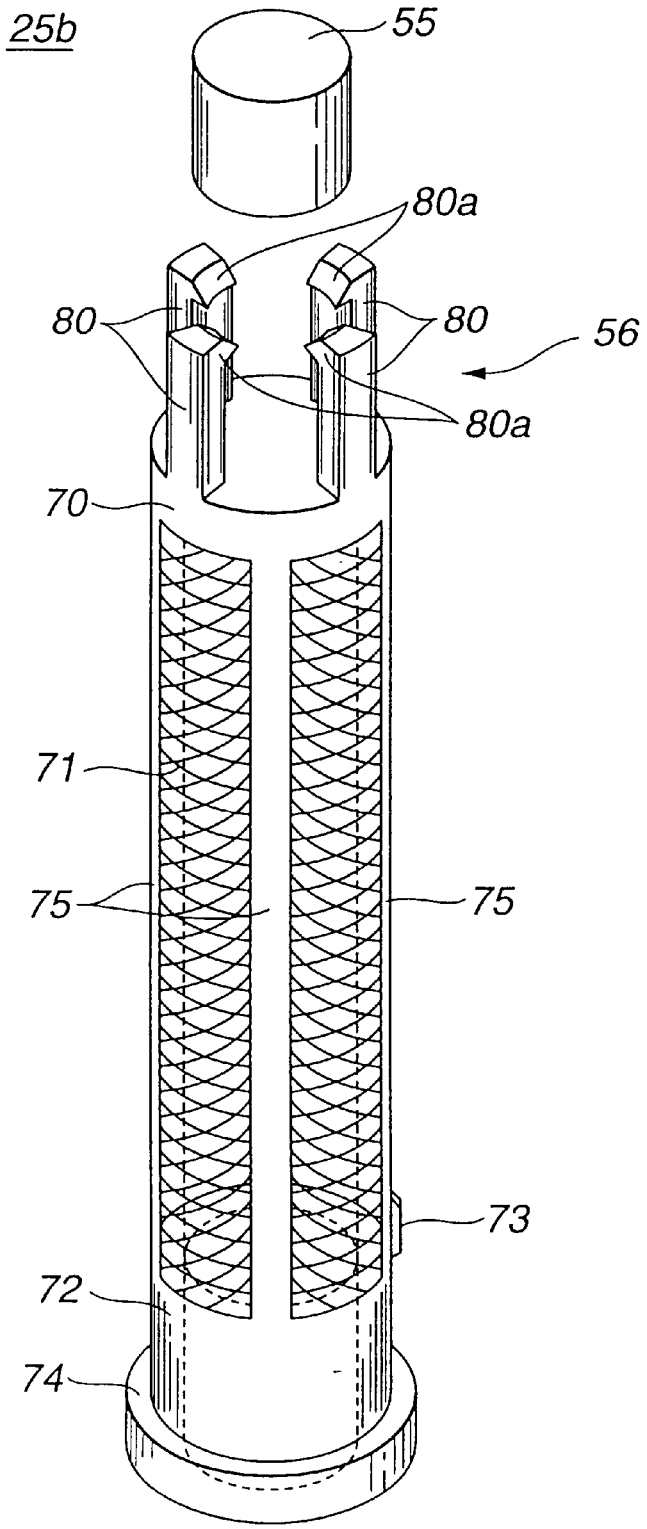
FIG. 16 is a view similar to FIG. 6, but showing a third strainer according to the present invention.
Figure 17:
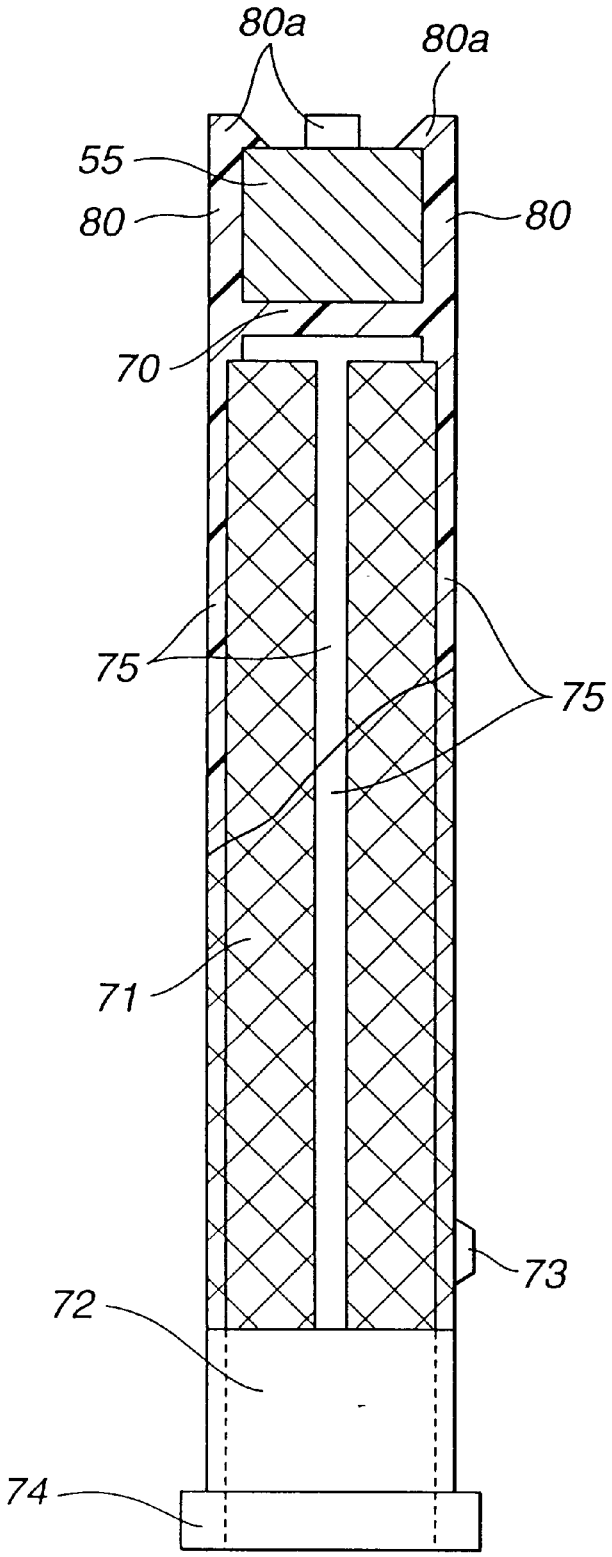
FIG. 17 is a sectional view showing the third strainer of FIG. 16.

FIGS. 16 and 17 show a strainer 25*b* according to an embodiment of the present invention, which is a modification of the strainer 25 shown in FIGS. 6 and 7. Similar to the strainer 25, the strainer 25*b* has a cylindrical head portion 70, a cylindrical net portion 71, a base portion 72 and supports 75. The strainer 25*b* can also be produced by an insert molding in which a cylindrical net is put into a resin mold, to form an integral (monolithic) member of the head portion 70, the cylindrical net portion 71, the base portion 72 and supports 75.

The strainer 25*b* is formed on the top surface of the head portion 70 with a holder 56 for holding the fluorescent dye 55. This holder 56 has four flexible arms 80 extending upward along the axis of the strainer 25*b*. The opposed two arms 80 are spaced from each other such that the fluorescent dye 55 is fit therebetween. Each arm 80 has a pawl 80*a* that is spaced away from the top surface of the head portion 70 such that the fluorescent dye 55 is fit between the pawl 80*a* and the top surface of the head portion 70. Thus, the fluorescent dye is prevented from falling down from the strainer 25*b*.

Figure 18:
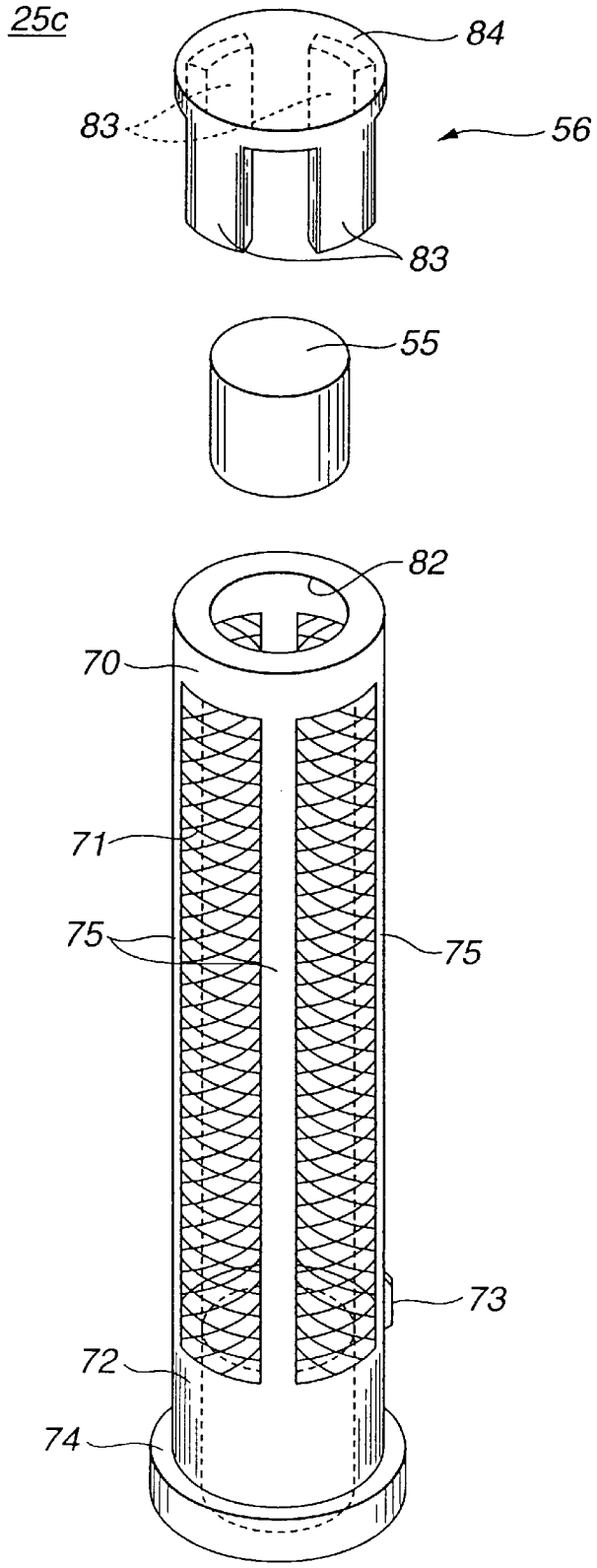
FIG. 18 is a view similar to FIG. 6, but showing a fourth strainer according to the present invention.
Figure 19:
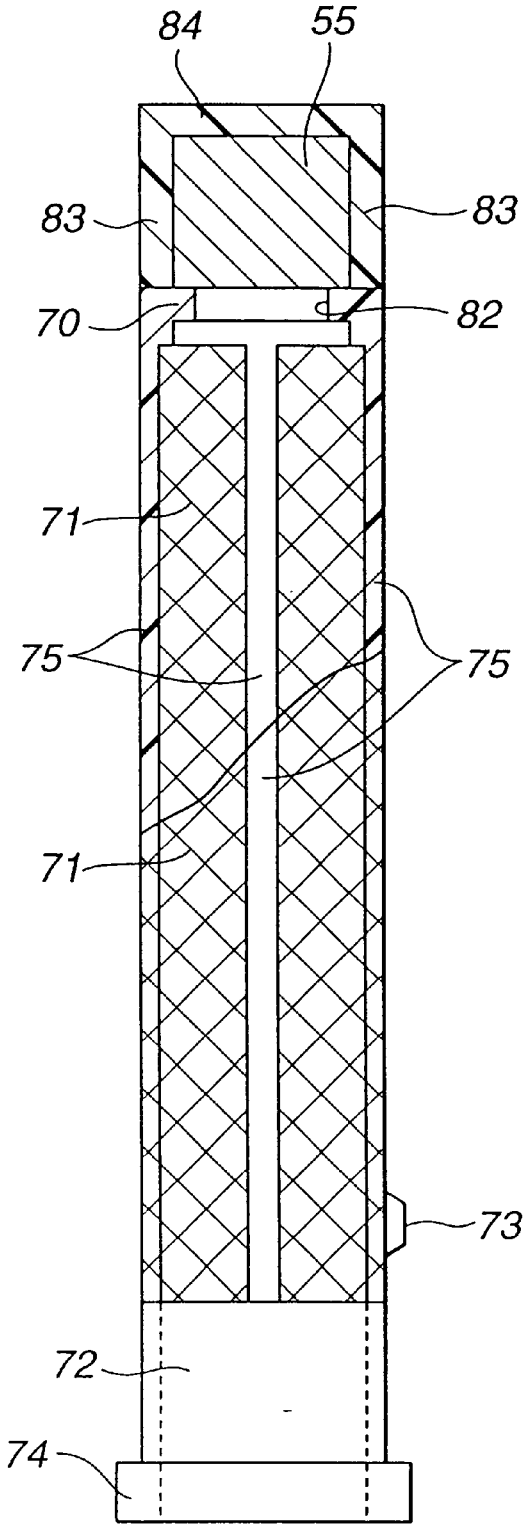
FIG. 19 is a sectional view showing the fourth strainer of FIG. 18.

FIGS. 18 and 19 show a strainer 25*c* according to an embodiment of the present invention, which is a modification of the strainer 25 shown in FIGS. 6 and 7. It is suitable to dispose the strainer 25*c* at the inlet 23. Similar to the strainer 25, the strainer 25*c* has a cylindrical head portion 70, a cylindrical net portion 71, a base portion 72 and supports 75. The strainer 25*c* can also be produced by an insert molding in which a cylindrical net is put into a resin mold, to form an integral (monolithic) member of the head portion 70, the cylindrical net portion 71, the base portion 72 and supports 75.

The strainer 25*c* has a holder 56 for holding the fluorescent dye 55. This holder 56 has a head portion 84 and four flexible leg portions 83 extending downward from the head portion 84. The bottom of each leg portion 83 may be secured to the top surface of the cylindrical head portion 70 by an adhesive or welding. Alternatively, although not shown in the drawings, the head portion 70 may be formed on its top surface with an engaging groove having a size for receiving therein the leg portions 83 of the holder 56. In fact, it is optional to provide a locking mechanism in which the bottom of each leg portion 83 is inserted into the engaging groove, and then the head portion 84 is turned to a locking position to lock the holder 56 (holding therein the fluorescent dye 55) onto the head portion 70 of the strainer 25*c*. With this, the fluorescent dye 55 is prevented from falling down from the strainer 25*c*. If the strainer 25*c* is disposed at the inlet 23, the refrigerant flows upward from the inlet 23 through an inner central hole 82 of the strainer 25*c* and then hits against the fluorescent dye 55. In this manner, it becomes easy to dissolve the fluorescent dye 55 in lubricating oil.

Figure 20:
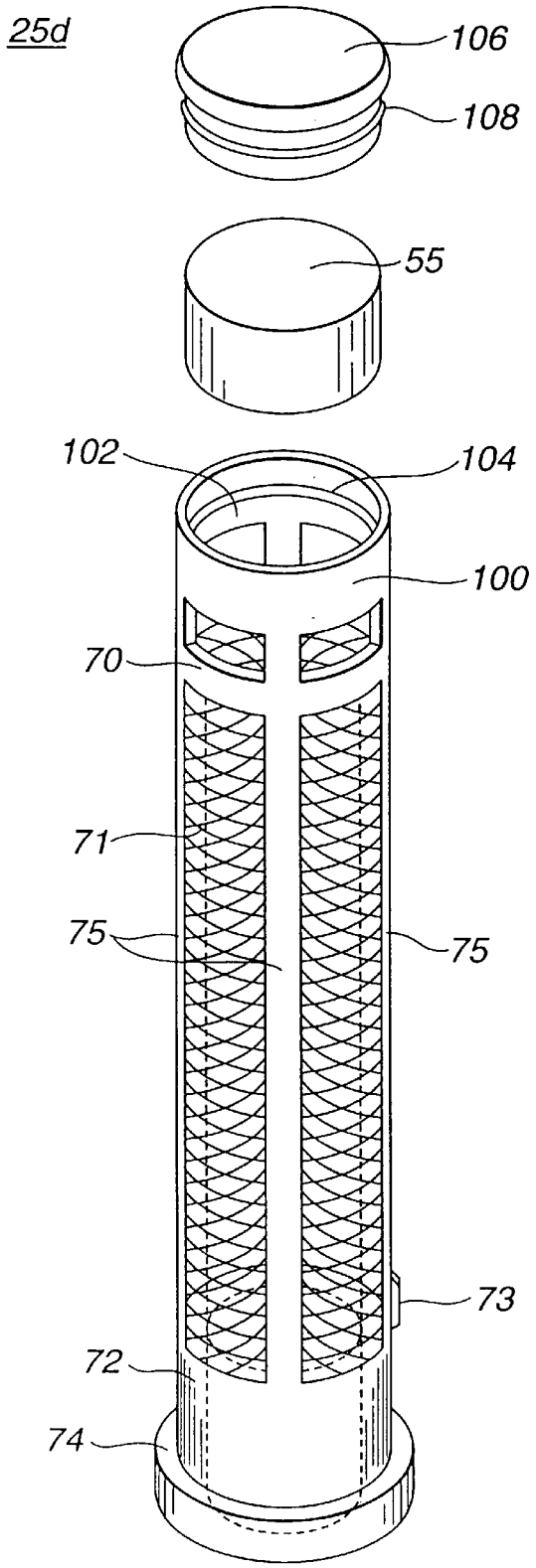
FIG. 20 is a view similar to FIG. 6, but showing a fifth strainer according to the present invention.
Figure 21:
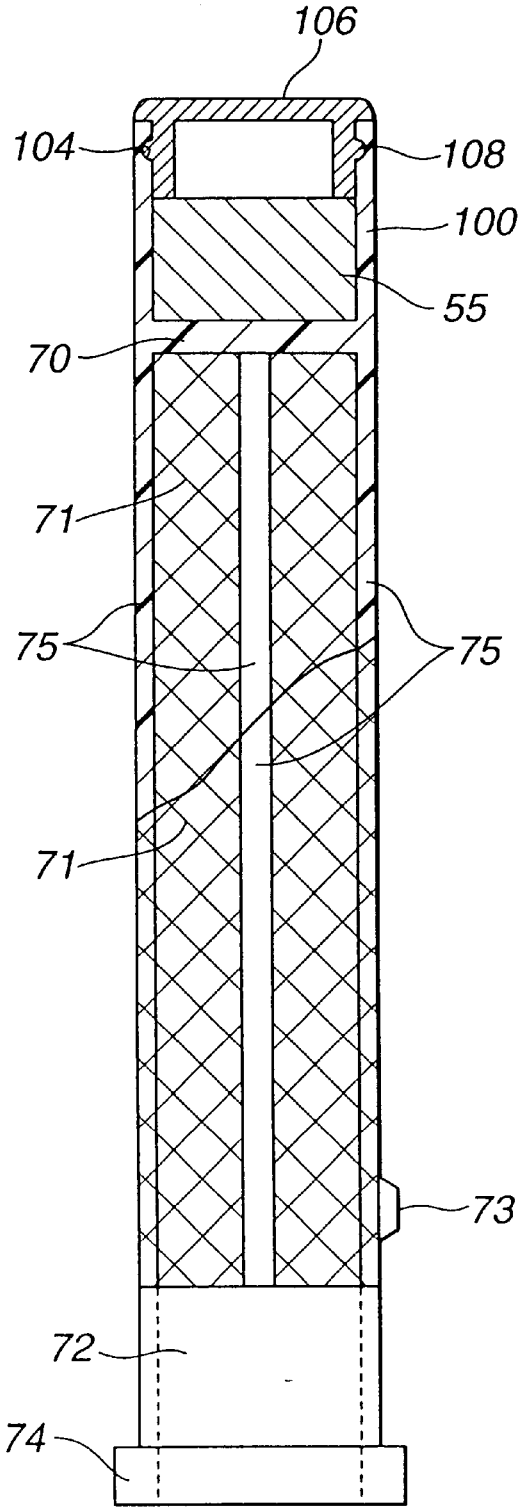
FIG. 21 is a sectional view showing the fifth strainer of FIG. 20.

FIGS. 20 and 21 show a strainer 25*d* according to an embodiment of the present invention, which is a modification of the strainer 25 shown in FIGS. 6 and 7. Similar to the strainer 25, the strainer 25*d* has a cylindrical head portion 70, a cylindrical net portion 71, a base portion 72 and supports 75.

The strainer 25*d* has a holder for holding the fluorescent dye 55. This holder has a supporting member 100 for supporting the fluorescent dye 55 on the head portion 70 of the strainer 25*d*. The supporting member 100 extends upward from the head portion 70 and has an inner surface 102 defining an opening in the supporting member 100. This opening has a size for receiving therein the fluorescent dye 55. The inner surface 102 has a groove 104. The holder further has a cap member 106 for covering the fluorescent dye 55 received in the opening of the supporting member 100. This cap member 106 has a projection 108 that is receivable in the groove 104 of the supporting member 100. Thus, the fluorescent dye 55 is prevented from falling down from the strainer 25*d*.

The entire disclosure of Japanese Patent Application No. 2000-327807 filed on Oct. 26, 2000, including specification, drawings, claims and summary, is incorporated herein by reference in its entirety.

What is claimed is:

1. A receiver-drier for use in an air conditioning system, said receiver-drier comprising:

a lower portion defining a lower chamber in said receiver-drier, said lower portion having an inlet adapted to receive an inlet pipe and for allowing a refrigerant of said air conditioning system to flow from said inlet pipe into said lower chamber and an outlet for allowing said refrigerant to flow out of said lower chamber, each of said inlet and said outlet being formed at a bottom of said lower portion;

an upper portion defining an upper chamber in said receiver-drier, said upper chamber being on top of said lower chamber and being charged with a desiccant for removing moisture from said refrigerant; and a strainer for removing foreign particles from said refrigerant, said strainer being disposed at a position in a flow of said refrigerant from said inlet to said outlet, wherein said inlet adapted to receive said inlet pipe is such that said inlet pipe is essentially non-intrusive into the upper chamber.

2. A receiver-drier according to claim 1, wherein said strainer comprises a fluorescent dye for detecting a refrigerant leak of said air conditioning system.

3. A receiver-drier according to claim 1, wherein said strainer is so dimensioned as to be inserted in said outlet and project into the lower chamber.

4. A receiver-drier according to claim 1, wherein said strainer comprises a cylindrical head portion, a base portion, and a cylindrical net portion for removing foreign particles from said refrigerant, said cylindrical net portion being provided between said cylindrical head portion and said base portion.

5. A receiver-drier according to claim 1, wherein said strainer is made of a resin material.

6. A receiver-drier according to claim 1, further comprising a partition for separating said lower and upper chambers from each other, said partition having a structure to allow said refrigerant to flow from said lower chamber to said upper chamber and vice versa.

7. A receiver-drier according to claim 1, further comprising a sensor for sensing a pressure of said refrigerant in said receiver-drier.

8. A receiver-drier according to claim 1, wherein said upper portion comprises a top portion having a construction such that said refrigerant is substantially prevented from flowing from said upper chamber in an upward direction.

9. A receiver-drier according to claim 1, wherein said lower portion comprises a guide pipe for guiding said refrigerant from said inlet to said upper chamber, said guide pipe extending from said inlet toward said upper chamber.

10. A receiver-drier according to claim 9, wherein said guide pipe has an axial length that is more than a half of an axial length of said lower chamber such that said refrigerant is introduced from said inlet into said upper chamber.

11. A receiver-drier according to claim 4, wherein said strainer further comprises a fluorescent dye for detecting a refrigerant leak of said air conditioning system, and wherein said cylindrical head portion of said strainer comprises a holder for holding said fluorescent dye.

12. A receiver-drier according to claim 4, wherein said strainer further comprises a holder for holding said fluorescent dye on a top surface of said cylindrical head portion.

13. A receiver-drier according to claim 11, wherein said holder of said trainer comprises:

a supporting member for supporting said fluorescent dye on said head portion of said strainer, said supporting member having an inner surface defining an opening in said supporting member, said opening having a size for receiving therein said fluorescent dye, said inner surface having a groove, said supporting member having a through opening for allowing a communication between an inside of said supporting member and an outside of said supporting member; and a cap member for covering said fluorescent dye received in said opening of said supporting member, said cap member having a projection that is receivable in said groove of said supporting member.

14. A receiver-drier according to claim 4, wherein the cylindrical net portion has a diameter which less than a diameter of said outlet.

15. A receiver-drier according to claim 1, wherein said strainer is provided with a holding mechanism for holding said strainer in said outlet.

16. The receiver-drier of claim 1, wherein said outlet is adapted to receive an outlet pipe so that it is essentially non-intrusive into the lower chamber.

17. A receiver-drier for use in an air conditioning system, said receiver-drier comprising:

a lower portion defining a lower chamber in said receiver-drier, said lower portion having an inlet adapted to receive an inlet pipe and for allowing a refrigerant of said air conditioning system to flow from said inlet pipe into said lower chamber and an outlet for allowing said refrigerant to flow out of said lower chamber, each of said inlet and said outlet being formed at a bottom of said lower portion;

an upper portion defining an upper chamber in said receiver-drier, said upper chamber being on top of said lower chamber and being charged with a desiccant for removing moisture from said refrigerant; and a strainer for removing foreign particles from said refrigerant, said strainer being disposed at a position in a flow of said refrigerant from said inlet to said outlet, wherein said inlet adapted to receive said inlet pipe is such that said inlet pipe is essentially non-intrusive into the upper chamber; and wherein said lower portion comprises a block for closing a bottom opening of said receiver-drier, said block having said inlet and said outlet, said inlet and said outlet being sized to receive elastomeric seals which are disposed about end portions of said inlet and outlet pipes.

18. A receiver-drier according to claim 17, wherein said strainer has an elongated cylindrical shape and is detachably attached to said block by inserting said strainer into said outlet of said block such that replacement is allowed for said strainer.

19. A receiver-drier according to claim 18, wherein each of said inlet and said outlet extends in a direction along a longitudinal direction of said receiver-drier and is formed to pass through said block, wherein said strainer comprises a cylindrical head portion, a base portion, and a cylindrical net portion for removing foreign particles from said refrigerant, said cylindrical net portion being provided between said cylindrical head portion and said base portion, and wherein said net portion of said strainer is inserted in said lower chamber, and said base portion of said strainer is inserted and held in said outlet of said block.

20. A receiver-drier, for use in an air conditioning system, said receiver-drier comprising:

a lower portion defining a lower chamber in said receiver-drier, said lower portion having an inlet for allowing a refrigerant of said air conditioning system to flow into said lower chamber and an outlet for allowing said refrigerant to flow out of said lower chamber, each of said inlet and said outlet being formed at a bottom of said lower portion;

an upper portion defining an upper chamber in said receiver-drier, said upper chamber being on top of said lower chamber and being charged with a desiccant for removing moisture from said refrigerant; and a strainer for removing foreign particles from said refrigerant, said strainer being disposed at a position in a flow of said refrigerant from said inlet to said outlet, wherein said strainer comprises a cylindrical head portion, a base portion, and a cylindrical net portion for removing foreign particles from said refrigerant, said cylindrical net portion being provided between said cylindrical head portion and said base portion, wherein said strainer further comprises a fluorescent dye for detecting a refrigerant leak of said air conditioning system, and wherein said cylindrical head portion of said strainer comprises a holder for holding said fluorescent dye, wherein said holder of said strainer comprises:

a base surface for supporting thereon said fluorescent dye; and at least two flexible arms that extend from said base surface and are spaced from each other by a distance such that said fluorescent dye is held between said at least two flexible arms.

21. A receiver-drier according to claim 20, wherein each flexible arm comprises a pawl that is spaced from said base surface by a distance such that said fluorescent dye is held between said base surface and said pawl.

22. A receiver-drier according to claim 21, wherein said holder further comprises first and second projections that extend from said base surface and are spaced from each other by a distance such that said fluorescent dye is held between said first and second projections.

23. A receiver-drier according to claim 21, further comprising a cover member for covering said fluorescent dye, said cover member being held between said fluorescent dye and said pawl.

24. A receiver-drier for use in an air conditioning system, said receiver-drier comprising:

a lower portion defining a lower chamber in said receiver-drier, said lower portion having an inlet adapted to receive an inlet pipe and for allowing a refrigerant of said air conditioning system to flow from said inlet pipe into said lower chamber and an outlet for allowing said refrigerant to flow out of said lower chamber, each of said inlet and said outlet being formed at a bottom of said lower portion;

an upper portion defining an upper chamber in said receiver-drier, said upper chamber being on top of said lower chamber and being charged with a desiccant for removing moisture from said refrigerant;

a strainer for removing foreign particles from said refrigerant, said strainer being disposed at a position in a flow of said refrigerant from said inlet to said outlet; and a sensor for sensing a pressure of said refrigerant in said receiver-drier, wherein said inlet adapted to receive said inlet pipe is such that said inlet pipe is essentially non-intrusive into the upper chamber.

25. A receiver-drier according to claim 24, wherein the strainer has a cylindrical net portion having a diameter which less than a diameter of said outlet.

26. A receiver-drier according to claim 24, wherein said strainer is provided with a holding mechanism for holding said strainer in said outlet.

27. A receiver-drier according to claim 26, wherein the holding mechanism comprises:

a flange which engages a stepped diameter portion in said outlet; and a projection which extends radially outward from the strainer and which is so sized as to resist retraction of the strainer from said outlet.

28. A receiver-drier according to claim 27, wherein the projection is sufficiently flexible to allow deflection as said strainer passes through said outlet.

29. The receiver-drier of claim 24, wherein said outlet is adapted to receive an outlet pipe so that it is essentially non-intrusive into the lower chamber.

30. The receiver-drier of claim 24, wherein said strainer extends in said outlet.

31. A receiver-drier for use in an air conditioning system, said receiver-drier comprising:

a first means for defining a lower chamber in said receiver-drier, said first means having an inlet adapted to receive an inlet pipe and for allowing a refrigerant of said air conditioning system to flow from said inlet pipe into said lower chamber and an outlet for allowing said refrigerant to flow out of said lower chamber, each of said inlet and said outlet being formed at a bottom of said lower portion;

a second means for defining an upper chamber in said receiver-drier, said upper chamber being on top of said lower chamber and being charged with a desiccant for removing moisture from said refrigerant; and a third means for removing foreign particles from said refrigerant, said third means being detachably attached to said first means by inserting said third means from an outside of said receiver-drier into said outlet, wherein said inlet adapted to receive said inlet pipe is such that said inlet pipe is essentially non-intrusive into the upper chamber.

32. A receiver-drier for use in an air conditioning system, said receiver-drier comprising:

a lower portion defining a lower chamber in said receiver-drier, said lower portion having an inlet adapted to receive an inlet pipe and for allowing a refrigerant of said air conditioning system to flow from said inlet pipe into said lower chamber and an outlet for allowing said refrigerant to flow out of said lower chamber, each of said inlet and said outlet being formed at a bottom of said lower portion;

an upper portion defining an upper chamber in said receiver-drier, said upper chamber being on top of said lower chamber and being charged with a desiccant for removing moisture from said refrigerant;

a strainer for removing foreign particles from said refrigerant, said strainer being disposed at a position in a flow of said refrigerant from said inlet to said outlet, wherein said inlet adapted to receive said inlet pipe is such that said inlet pipe is essentially non-intrusive into the upper chamber; and a holding mechanism comprising:

a flange which engages a step diameter portion in said outlet; and a projection which extends radially outward from the strainer and which is so sized and constructed as to resist retraction of the strainer from said outlet.

33. A receiver-drier according to claim 32, wherein the projection is sufficiently flexible to allow deflection as said strainer passes through said outlet.

* * * * *